US008869663B2

(12) United States Patent
Greyshock et al.

(10) Patent No.: US 8,869,663 B2
(45) Date of Patent: Oct. 28, 2014

(54) SYSTEM, METHOD AND CORRESPONDING APPARATUS FOR DETECTING PERFORATIONS ON A UNIT DOSE BLISTER CARD

(71) Applicant: McKesson Automation, Inc., Cranberry, PA (US)

(72) Inventors: Shawn T. Greyshock, Tarentum, PA (US); Patrick J. Braun, Pittsburgh, PA (US)

(73) Assignee: Aesynt Incorporated, Cranberry, PA (US)

( * ) Notice: Subject to any disclaimer, the term of this patent is extended or adjusted under 35 U.S.C. 154(b) by 0 days.

(21) Appl. No.: 13/680,774

(22) Filed: Nov. 19, 2012

(65) Prior Publication Data

US 2013/0139662 A1 Jun. 6, 2013

Related U.S. Application Data

(63) Continuation of application No. 12/411,022, filed on Mar. 25, 2009, now abandoned.

(51) Int. Cl.
*B26D 5/32* (2006.01)

(52) U.S. Cl.
USPC ..... 83/13; 83/371; 83/467.1

(58) Field of Classification Search
USPC ..... 83/371, 365, 467.1
IPC ..... B26D 5/32
See application file for complete search history.

(56) References Cited

U.S. PATENT DOCUMENTS

| | | | | | |
|---|---|---|---|---|---|
| 635,457 | A | | 10/1899 | Yandall | |
| 678,441 | A | | 7/1901 | Stevens | |
| 1,564,794 | A | * | 12/1925 | Humphreys | 226/2 |
| 2,270,473 | A | | 1/1942 | Porcelli | |
| 2,758,710 | A | | 8/1956 | Egmont | |
| 2,782,989 | A | * | 2/1957 | Knox | 235/450 |
| 3,160,048 | A | | 12/1964 | Barley | |
| 3,182,542 | A | | 5/1965 | Cochran | |
| 3,329,181 | A | * | 7/1967 | Buss et al. | 83/34 |
| 3,340,384 | A | * | 9/1967 | Rosen et al. | 235/443 |
| 3,656,391 | A | | 4/1972 | Von Arx | |
| 4,253,364 | A | | 3/1981 | Kiefer et al. | |
| 4,337,679 | A | | 7/1982 | Krylov et al. | |
| 4,679,473 | A | | 7/1987 | Hirata et al. | |
| 4,716,799 | A | * | 1/1988 | Hartmann | 83/42 |
| 4,717,042 | A | | 1/1988 | McLaughlin | |
| 4,785,969 | A | | 11/1988 | McLaughlin | |
| 4,847,764 | A | | 7/1989 | Halvorson | |
| 4,932,301 | A | | 6/1990 | Buck | |
| 5,014,875 | A | | 5/1991 | McLaughlin et al. | |
| 5,048,816 | A | | 9/1991 | Chun et al. | |
| 5,131,301 | A | | 7/1992 | Gergek | |
| 5,190,185 | A | | 3/1993 | Blechl | |
| 5,314,243 | A | | 5/1994 | McDonald et al. | |
| 5,346,297 | A | | 9/1994 | Colson, Jr. et al. | |
| 5,346,456 | A | * | 9/1994 | Rutledge et al. | 493/211 |

(Continued)

*Primary Examiner* — Kenneth E. Peterson
(74) *Attorney, Agent, or Firm* — Alston & Bird LLP

(57) ABSTRACT

A method, system and corresponding apparatus are provided for determining a perforation location on a blister card comprising at least one unit dose blister of medication. In particular, a data extraction operation with respect to a surface of the blister card may be performed and perforation location information defining a location of at least one perforation adjoining two unit dose blisters on the blister card may be determined based on the data extracted.

12 Claims, 13 Drawing Sheets

(56) References Cited

U.S. PATENT DOCUMENTS

| | | | |
|---|---|---|---|
| 5,377,572 | A | 1/1995 | Sonobe et al. |
| 5,377,864 | A | 1/1995 | Blechl et al. |
| 5,405,048 | A | 4/1995 | Rogers et al. |
| 5,431,299 | A | 7/1995 | Brewer et al. |
| 5,460,294 | A | 10/1995 | Williams |
| 5,468,110 | A | 11/1995 | McDonald et al. |
| 5,480,062 | A | 1/1996 | Rogers et al. |
| 5,520,450 | A | 5/1996 | Colson, Jr. et al. |
| 5,564,803 | A | 10/1996 | McDonald et al. |
| 5,593,267 | A | 1/1997 | McDonald et al. |
| 5,630,347 | A | 5/1997 | Elvio |
| 5,661,978 | A | 9/1997 | Holmes et al. |
| D384,578 | S | 10/1997 | Wangu et al. |
| 5,713,485 | A | 2/1998 | Liff et al. |
| 5,716,114 | A | 2/1998 | Holmes et al. |
| 5,745,366 | A | 4/1998 | Higham et al. |
| 5,761,877 | A | 6/1998 | Quandt |
| 5,797,515 | A | 8/1998 | Liff et al. |
| 5,805,456 | A | 9/1998 | Higham et al. |
| 5,807,222 | A | 9/1998 | Totani |
| 5,842,976 | A | 12/1998 | Williamson |
| 5,878,885 | A | 3/1999 | Wangu et al. |
| 5,880,443 | A | 3/1999 | McDonald et al. |
| 5,883,806 | A | 3/1999 | Meador et al. |
| 5,893,697 | A | 4/1999 | Zini et al. |
| 5,905,653 | A | 5/1999 | Higham et al. |
| 5,912,818 | A | 6/1999 | McGrady et al. |
| 5,927,540 | A | 7/1999 | Godlewski |
| 5,940,306 | A | 8/1999 | Gardner et al. |
| 5,971,593 | A | 10/1999 | McGrady |
| 6,003,006 | A | 12/1999 | Colella et al. |
| 6,011,999 | A | 1/2000 | Holmes |
| 6,021,392 | A | 2/2000 | Lester et al. |
| 6,035,610 | A | 3/2000 | Vonderhorst et al. |
| 6,039,467 | A | 3/2000 | Holmes |
| 6,065,819 | A | 5/2000 | Holmes et al. |
| 6,068,156 | A | 5/2000 | Liff et al. |
| 6,109,774 | A | 8/2000 | Holmes et al. |
| 6,112,502 | A | 9/2000 | Frederick et al. |
| 6,116,461 | A | 9/2000 | Broadfield et al. |
| 6,151,536 | A | 11/2000 | Arnold et al. |
| 6,170,230 | B1 | 1/2001 | Chudy et al. |
| 6,176,392 | B1 | 1/2001 | William et al. |
| 6,189,727 | B1 | 2/2001 | Shoenfeld |
| 6,223,934 | B1 | 5/2001 | Shoenfeld |
| 6,256,967 | B1 | 7/2001 | Hebron et al. |
| 6,283,322 | B1 | 9/2001 | Liff et al. |
| 6,289,656 | B1 | 9/2001 | Wangu et al. |
| 6,338,007 | B1 | 1/2002 | Broadfield et al. |
| 6,339,732 | B1 | 1/2002 | Phoon et al. |
| 6,361,263 | B1 | 3/2002 | Dewey et al. |
| 6,370,841 | B1 | 4/2002 | Chudy et al. |
| 6,449,927 | B2 | 9/2002 | Hebron et al. |
| 6,471,089 | B2 | 10/2002 | Liff et al. |
| 6,497,342 | B2 | 12/2002 | Zhang et al. |
| 6,499,270 | B2 | 12/2002 | Peroni et al. |
| 6,532,399 | B2 | 3/2003 | Mase |
| 6,564,121 | B1 | 5/2003 | Wallace et al. |
| 6,581,798 | B2 | 6/2003 | Liff et al. |
| 6,609,047 | B1 | 8/2003 | Lipps |
| 6,611,733 | B1 | 8/2003 | De La Huerga |
| 6,625,952 | B1 | 9/2003 | Chudy et al. |
| 6,640,159 | B2 | 10/2003 | Holmes et al. |
| 6,650,964 | B2 | 11/2003 | Spano, Jr. et al. |
| 6,671,579 | B2 | 12/2003 | Spano, Jr. et al. |
| 6,681,149 | B2 | 1/2004 | William et al. |
| 6,742,671 | B2 | 6/2004 | Hebron et al. |
| 6,755,931 | B2 | 6/2004 | Vollm et al. |
| 6,760,643 | B2 | 7/2004 | Lipps |
| 6,776,304 | B2 | 8/2004 | Liff et al. |
| 6,785,589 | B2 | 8/2004 | Eggenberger et al. |
| 6,790,198 | B1 | 9/2004 | White et al. |
| 6,793,424 | B2 | 9/2004 | Yamada et al. |
| 6,814,254 | B2 | 11/2004 | Liff et al. |
| 6,814,255 | B2 | 11/2004 | Liff et al. |
| 6,847,861 | B2 | 1/2005 | Lunak et al. |
| 6,874,684 | B1 | 4/2005 | Denenberg et al. |
| 6,892,780 | B2 | 5/2005 | Vollm et al. |
| 6,895,304 | B2 | 5/2005 | Spano, Jr. et al. |
| 6,975,922 | B2 | 12/2005 | Duncan et al. |
| 6,985,797 | B2 | 1/2006 | Spano, Jr. et al. |
| 6,996,455 | B2 | 2/2006 | Eggenberger et al. |
| 7,010,389 | B2 | 3/2006 | Lunak et al. |
| 7,014,063 | B2 | 3/2006 | Shows et al. |
| 7,016,766 | B2 | 3/2006 | William et al. |
| 7,040,504 | B2 | 5/2006 | Broadfield et al. |
| 7,052,097 | B2 | 5/2006 | Meek, Jr. et al. |
| 7,072,737 | B2 | 7/2006 | Lunak et al. |
| 7,072,855 | B1 | 7/2006 | Godlewski et al. |
| 7,077,286 | B2 | 7/2006 | Shows et al. |
| 7,085,621 | B2 | 8/2006 | Spano, Jr. et al. |
| 7,092,796 | B2 | 8/2006 | Vanderveen |
| 7,093,755 | B2 | 8/2006 | Jordan et al. |
| 7,100,792 | B2 | 9/2006 | Hunter et al. |
| 7,103,419 | B2 | 9/2006 | Engleson et al. |
| 7,111,780 | B2 | 9/2006 | Broussard et al. |
| 7,139,639 | B2 | 11/2006 | Broussard et al. |
| 7,150,724 | B2 | 12/2006 | Morris et al. |
| 7,171,277 | B2 | 1/2007 | Engleson et al. |
| 7,182,007 | B2 * | 2/2007 | Berge et al. ..... 83/13 |
| 7,218,231 | B2 | 5/2007 | Higham |
| 7,228,198 | B2 | 6/2007 | Vollm et al. |
| 7,249,688 | B2 | 7/2007 | Hunter et al. |
| 7,348,884 | B2 | 3/2008 | Higham |
| 7,417,729 | B2 | 8/2008 | Greenwald |
| 7,419,133 | B2 | 9/2008 | Clarke et al. |
| 7,426,425 | B2 | 9/2008 | Meek, Jr. et al. |
| 7,428,859 | B2 | 9/2008 | Fujita et al. |
| 7,540,222 | B2 | 6/2009 | Kim |
| 7,554,449 | B2 | 6/2009 | Higham |
| 7,571,024 | B2 | 8/2009 | Duncan et al. |
| 7,588,167 | B2 | 9/2009 | Hunter et al. |
| 7,748,628 | B2 | 7/2010 | Greyshock |
| 7,971,327 | B2 * | 7/2011 | Deringor et al. ..... 29/33 R |
| 8,036,773 | B2 | 10/2011 | Braun et al. |
| 2001/0049986 | A1 | 12/2001 | Roberts et al. |
| 2006/0123969 | A1 | 6/2006 | Fujita et al. |
| 2007/0261525 | A1 | 11/2007 | Yamaguchi et al. |
| 2007/0265730 | A1 | 11/2007 | Greyshock |

* cited by examiner

SYSTEM, METHOD AND CORRESPONDING APPARATUS FOR DETECTING PERFORATIONS ON A UNIT DOSE BLISTER CARD

CROSS REFERENCE TO RELATED APPLICATIONS

This application is a continuation of and claims priority to U.S. application Ser. No. 12/411,022, filed Mar. 25, 2009, the entire contents of which are hereby incorporated by reference.

FIELD OF THE INVENTION

Exemplary embodiments of the present invention relate generally to identifying perforations between units on a unit dose blister card.

BACKGROUND OF THE INVENTION

In a typical hospital, nursing home, or other similar institution, doctors will visit their patients on a routine basis and prescribe various medications for each patient. In turn, each patient will likely be placed on a certain medication treatment plan that requires that he or she take one or more doses of various medications daily. Some medications may require that they be administered only at certain times of the day (e.g., after meals) and/or at intervals of one or more hours each day. In addition, patients may request certain medications on an elective basis for complaints, such as head or body aches. These requests are typically included with the doctor's medication request or prescription that he or she sends to a pharmacy of the hospital for filling.

Medication requests or prescriptions received by the pharmacy will likely be checked by a registered pharmacist and then entered into the pharmacy information system. These requests reflect not only orders that are added to a particular patient's treatment plan, but also changes in a patient's existing treatment plan. The pharmacy information system combines this information with the patient's existing medication schedule and develops a patient medication profile. Using the patient medication profile, a fill list can be created that lists all medications that must be distributed to all patients for a given time period (e.g., a day).

In some instances, this list is printed and used by a pharmacist or pharmacy technician to hand pick each of the drugs needed for each patient (in the form of unit doses) and place those drugs in corresponding patient-specific medication containers (e.g., boxes, bins or bags). A registered pharmacist then checks the accuracy of the patient order, and, assuming the order was accurate, the individual patient boxes are loaded into a large transport cart and delivered to a nursing unit.

Several drawbacks exist, however, to this method of medication retrieval and distribution. In particular, it is very time consuming and manpower intensive. As a result, systems were created for automating the process of retrieving unit dose medications and distributing them to patients according to their respective medication profiles. One example of such a system is the ROBOT-Rx® system, offered by McKesson Automation Inc. and described in U.S. Pat. Nos. 5,468,110, 5,593,267 and 5,880,443, and other examples are described in U.S. patent application Ser. Nos. 11/382,605, filed May 10, 2006, 11/611,956, filed Dec. 18, 2006 and 11/755,207, filed May 30, 2007, the contents of which are hereby incorporated herein by reference.

The ROBOT-Rx® system, like other similar systems, is a stationary robotic system that automates the drug storing, dispensing, returning, restocking and crediting process by using barcode technology. In particular, single doses of medications are re-packaged, for example in a clear plastic bag, so that each package contains a barcode corresponding to the package contents. The barcode may include the name of the medication, quantity, weight, instructions for use and/or expiration date.

The packaged medications are then stored in a storage area, such as a storage rack having a frame and a plurality of rod supports on which each package can be hung in a manner that provides each with an X, Y coordinate. Using the X, Y coordinates, packages can then be selected by an automated picking means (e.g., a robotic arm capable of moving at least in three, mutually orthogonal directions designated X, Y and Z), for distribution to individual patients.

More specifically, in one instance, a pharmacist or technician may manually enter the identification of a specific medication he or she would like the automated system to retrieve, for example, as a patient's first dose, in an emergency situation. The automated system, and, in particular, a computer associated with the automated system, would then locate the desired medication (i.e., the X, Y and Z coordinates of the medication) and instruct the picking means to retrieve the medication at that location. In another instance, the fill list created based on each patient's medication profile may be communicated to the computer associated with the automated system, providing the automated system with a current list of all patients and their individual medication needs. The computer also maintains a database of all medications stored in the storage area along with their corresponding X, Y and Z coordinates.

Patient-specific containers (e.g., drawers or bins) displaying barcodes that include the corresponding patient's unique identification code are placed on a conveyer belt associated with the automated system. At one point on the belt, a barcode reader reads the barcode displayed on the box and communicates the patient's identification to the computer. The computer will then retrieve the patient's medication needs from the fill list, and determine the corresponding coordinates for each medication by accessing the database.

The computer can then guide the picking means to select the desired unit dose medications and deposit them in the patient-specific boxes or containers. In particular, the picking means, which also includes a barcode reader, moves to the designated location of a particular medication, as instructed by the computer, scans the barcode displayed on the package containing the medication to determine the identification of the medication contained in the package, and provides the identity to the computer.

After the computer confirms that the correct unit dose medication is contained in the package, the picking means will remove the package from the storage area (e.g., using a vacuum generator to produce suction to pull the package off the rod, or other holding means, and hold the package until it can be deposited) and drop it into the patient-specific container.

The process is repeated until the patient's prescription has been filled (i.e., until the patient-specific medication container contains each dose of medication to be taken by the patient in the given time period or, in the instance where the unit dose retrieved the first dose for a new patient, until that first dose has been retrieved). The conveyor belt then moves the patient-specific container to a check station where an operator can use yet another barcode reader to scan the barcode label on the patient-specific container to retrieve and display the patient's prescription, as well as to scan the barcodes on each package in the container to verify that the medications are correct.

As described above, unit dose medications dispensed robotically may be packaged into bags, boxes or a variety of other over-wraps prior to being stored in the storage area. This repackaging effort is performed for several reasons. First, the size and shape of the raw packages vary greatly; therefore, without some commonality in product shape, robotic handling becomes extremely difficult. Second, while robotic systems typically rely on barcodes to identify the products throughout the process, the majority of products originating from various manufacturers do not contain barcodes of any kind or are inconsistent with respect to the information they provide. Accordingly, in these instances, over-wrapping the unit dose with a package containing a barcode may be accomplished for identification purposes.

More recently, efforts have been made to reduce any need for repackaging since, for example, repackaging adds material costs to the final product and requires both additional technician time to perform the packaging as well as additional pharmacist time to validate the content of the package against the description on the label. In addition, repacking by a hospital, or similar institution, shortens the expiration date of the repackaged item based on United States Pharmacopeia/National Formulary (USP/NF) repackaging standards. Moreover, since efforts are being made to ensure that all human drug products have a barcode on the smallest container or package distributed which, in many instances, is the unit dose medication, each unit dose on a unit dose blister card will have a barcode thereon. This includes all human prescription drug products and over-the-counter drugs that are dispensed pursuant to an order in the hospital. The barcode must contain, at a minimum, a National Drug Code (NDC) in a linear barcode, in the Uniform Code Council (UCC) or Health Industry Business Communications Council (HIBCC) format. Following the effective date of this mandate, assuming that the unit dose medications are the smallest container or package used, therefore, all unit dose medications will contain barcodes that can be used by robotic dispensing systems, thus eliminating the need to overwrap or repackage merely for identification purposes.

However, even though improvements may be achieved by enhancing the utility of an automated dispensing system in relation to eliminating repackaging or over-wrapping operations, such systems still require a fair amount of manual intervention to prepare the medications for automated dispensing. Additionally, there is no standard shape or configuration for unit dose blister cards, so automatic dispensing of unit doses was a challenge. This challenge was initially met by U.S. patent application Ser. Nos. 11/382,605, filed May 10, 2006, which provided a robotic device capable of dispensing unit dose blisters automatically. However, a requirement still remained for each of the unit dose blisters to be singulated manually. For example, a technician must typically undertake the tedious task of manual separation of each single unit dose blister for singulation and placement of such unit dose blisters, oriented bar code up, into a dedicated tray cavity. In some cases, technicians may be required to singulate up to three to four thousand doses per day (or more). Accordingly, it may be desirable to provide a mechanism by which to automatically singulate unit doses on a blister card.

BRIEF SUMMARY OF THE INVENTION

In general, exemplary embodiments of the present invention provide an improvement over the known prior art by, among other things, providing a means for handling unit dose blisters in a manner that permits identification of the location of perforations between unit dose blisters on a blister card. The blister card may then be reliably and automatically cut so that each unit dose blister is singulated without increasing the risk of penetrating the seal on any of the unit dose blisters.

In particular, according to one aspect of the present invention, a storage apparatus is provided that is configured to accept a plurality of different types of unit dose packages. The storage apparatus of this aspect of the present invention may comprise a carrier configured to hold a plurality of different types of unit dose packages of different shapes and sizes, such that when held, respective unit dose packages lie and are maintained in a predetermined plane relative to the carrier.

In one exemplary embodiment, a method of determining a perforation location on a blister card comprising at least one unit dose blister of medication is provided. The method may include performing a data extraction operation with respect to a surface of the blister card and determining perforation location information defining a location of at least one perforation adjoining two unit dose blisters on the blister card based on the data extracted.

In another exemplary embodiment, an apparatus for determining a perforation location on a blister card comprising at least one unit dose blister of medication is provided. The apparatus may include a perforation detector configured to perform a data extraction operation with respect to a surface of the blister card and determine perforation location information defining a location of at least one perforation adjoining two unit dose blisters on the blister card based on the data extracted.

In another exemplary embodiment, a system for determining a perforation location on a blister card comprising at least one unit dose blister of medication is provided. The system may include a perforation detector and a cutter. The perforation detector may be configured to perform a data extraction operation with respect to a surface of the blister card and determine perforation location information defining a location of at least one perforation adjoining two unit dose blisters on the blister card based on the data extracted. The cutter may be configured to utilize the perforation location information to singulate two unit dose blisters by cutting the blister card substantially along the perforation.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

In general, exemplary embodiments of the present invention provide a mechanism by which unit dose blisters may be separated either automatically or with minimal manual assistance. In this regard, embodiments of the present invention may further provide a mechanism by which perforations that separate each unit dose blister may be detected on a blister card. Thereafter, a cutting device may be employed to cut along the detected perforations in order to cingulate the unit dose blisters. In some cases, by detecting and thereafter cutting based on the detected perforations, singulation may be accomplished with respect to unit dose blisters on blister cards having various different shapes and/or orientations in a manner that reduces the likelihood of cutting into the seal around each unit dose blister or the barcode or human readable text that identifies the medication in the unit dose blister. For example, the blister card itself may experience alignment irregularities that place the perforations (and therefore also the sealed portions of each unit dose blister on the blister card) in positions that are not consistent relative to the edges of the blister cards when compared to other blister cards among a plurality of blister cards for different or even in some cases the same type of product. Thus, embodiments of the present invention may provide a mechanism for singulating and thereafter handling unit dose packages in their natural, raw state in a repeatable fashion so that they can be selectively retrieved and delivered, for example by one of the automatic retrieval systems discussed above (e.g., the ROBOT-Rx® system or a robot system able to handle blister dispensing such as that described in U.S. patent application Ser. Nos. 11/382,605, filed May 10, 2006).

Figure 1:
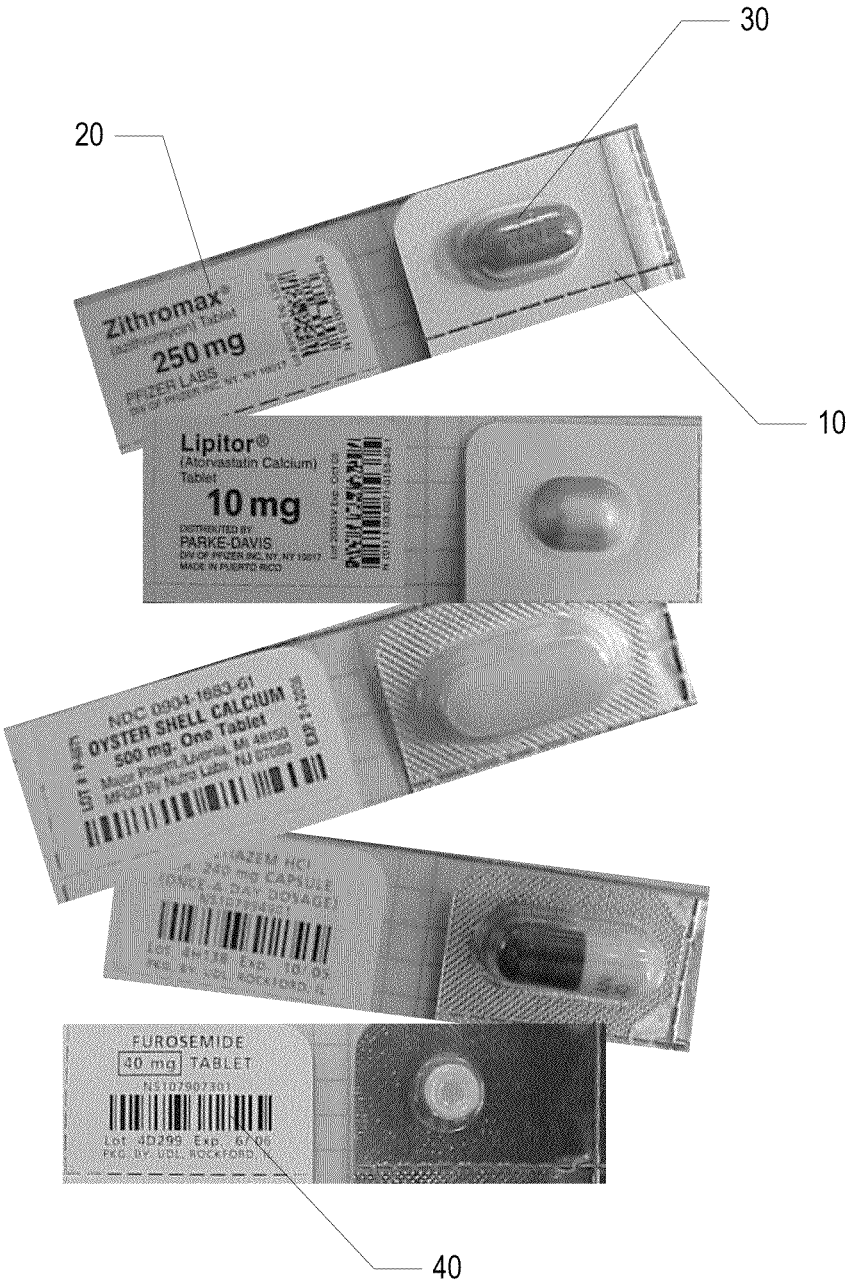
FIG. 1 illustrates several unit dose blisters.

The term "unit dose blister" refers to a unit dose medication, or one or more oral solids of the same or different strength, form or type, that has been sealed in a package, such as a vinyl and foil package in which the vinyl conforms to the shape of the medication. The vinyl is typically sealed to a foil that offers a flat surface with medication information printed on the opposite side from the vinyl cavity. FIG. 1 illustrates several examples of unit dose blisters. As shown, the unit dose blister may include a support panel having opposed first 10 and second 20 sides, wherein the unit dose medication 30 (i.e., the one or more oral solids) is positioned proximate the first side 10 of the support panel, and an identification code 40 (e.g., a barcode, radio frequency identification (RFID) tag, or simple text including any number and combination of alphanumeric characters) including information identifying the unit dose medication 30 is displayed on the second side 20 of the support panel.

Figure 2:
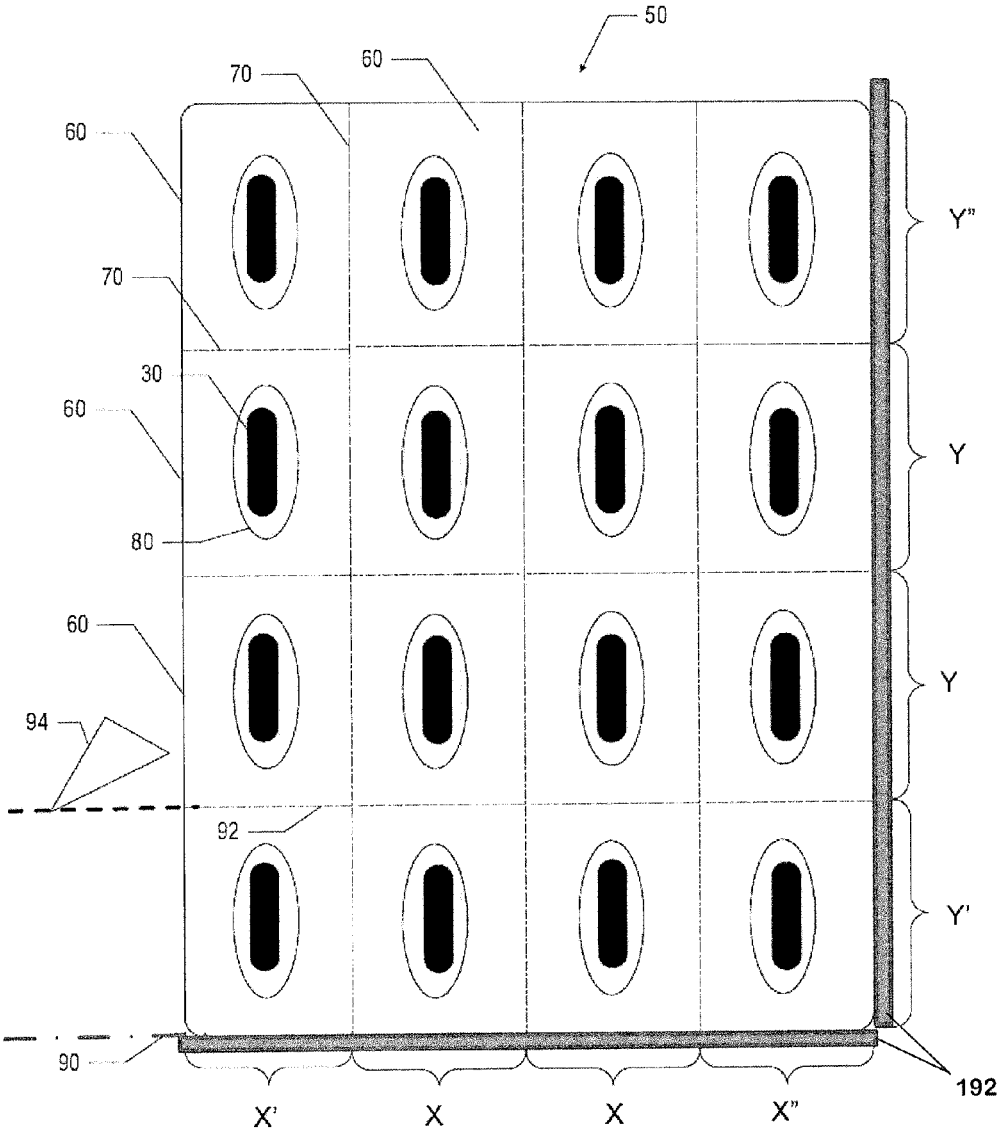
FIG. 2 illustrates several unit dose blisters within a blister card.

When unit dose medications are packaged into a blister, they are typically packaged with several medications per blister card. Thus, there are a corresponding number of equally-spaced vinyl foamed cavities per blister card. These cavities are typically separated by a perforation. During formation of a blister card, several manufacturing stations are encountered, but there is no correlation between the handling techniques employed at each station. Accordingly, a blister card that passes through a station for forming a cavity, labeling of the blister, punching of the blister receptacle, punching out of the card, etc., may not be handled in the same manner at each station as the previous or subsequent blister card. Accordingly, inconsistencies may be created between different blister cards. A singulated blister is one that has been separated from a blister card typically along its perforation. FIG. 2 illustrates a diagram of a blister card 50 according to an exemplary embodiment. As shown in FIG. 2, the blister card 50 may include a plurality of unit dose blisters 60 separated by perforations 70. The perforations 70 may extend between each adjacent unit dose blister 60 in substantially a straight line from one end of the blister card 50 to an opposite end of the blister card 50 in both horizontal and vertical directions. As such, one set of perforations (e.g., extending in a substantially horizontal direction) may be intersected by another set of perforations (e.g., extending in a substantially vertical direction) at approximately a right angle. Each unit dose blister 60 may include one unit dose medication 30 disposed in a vinyl cavity 80. The vinyl cavity 80 of each unit dose blister 60 may be approximately centrally located with respect to edges of the corresponding unit dose blister 60 as defined by the perforations 70 and/or blister card 50 edges that are immediately adjacent to the corresponding unit dose blister 60.

In an exemplary embodiment, it may be expected that a distance between perforations 70 is relatively constant along a given direction. However, a distance between a perforation and an edge of the blister card 50 may not be the same as the distance between perforations. Thus, for example, as shown in FIG. 2, a horizontal distance between each perforation may be distance X. However, a horizontal distance between a first edge of the blister card 50 and a first perforation encountered when extending across the blister card 50 in the horizontal direction (e.g., distance X') may not necessarily be equal to distance X. Additionally, a horizontal distance between a second edge of the blister card 50 and a first perforation encountered when extending across the blister card 50 in the horizontal direction (e.g., distance X") may not necessarily be equal to distance X (or X'). Similarly, a vertical distance between each perforation may be distance Y and a vertical distance between a third edge (e.g., reference edge 90) of the blister card 50 and a first perforation (e.g., perforation 92) encountered when extending across the blister card 50 in the vertical direction (e.g., distance Y') may not necessarily be equal to distance Y. Additionally, a horizontal distance between a fourth edge of the blister card 50 and a first perforation encountered when extending across the blister card 50 in the horizontal direction (e.g., distance Y") may not necessarily be equal to distance Y (or Y'). Thus, embodiments of the present invention may be useful in determining the locations of the perforations 70 for use in directing cutting (e.g., via blade 94) or singulation of each of the unit dose blisters 60 of the blister card 50.

As one of ordinary skill in the art will recognize, while reference is made throughout to unit dose blisters of the form described above, these unit dose blisters provide just one form in which unit dose medications may be packaged. Use of unit dose blisters in the description of exemplary embodiments included herein should not, therefore, be taken as limiting the scope of the present invention to use with such unit dose packages. In contrast, other unit dose packages may similarly be used in connection with exemplary embodiments without departing from the spirit and scope of the present invention. Furthermore, it should be noted that although the blister card 50 of FIG. 2 shows a 4×4 unit dose configuration, other configurations are also possible including the more common 2×5 configuration and any other configuration (e.g., 1×5, 10×10, etc.).

Figure 3:
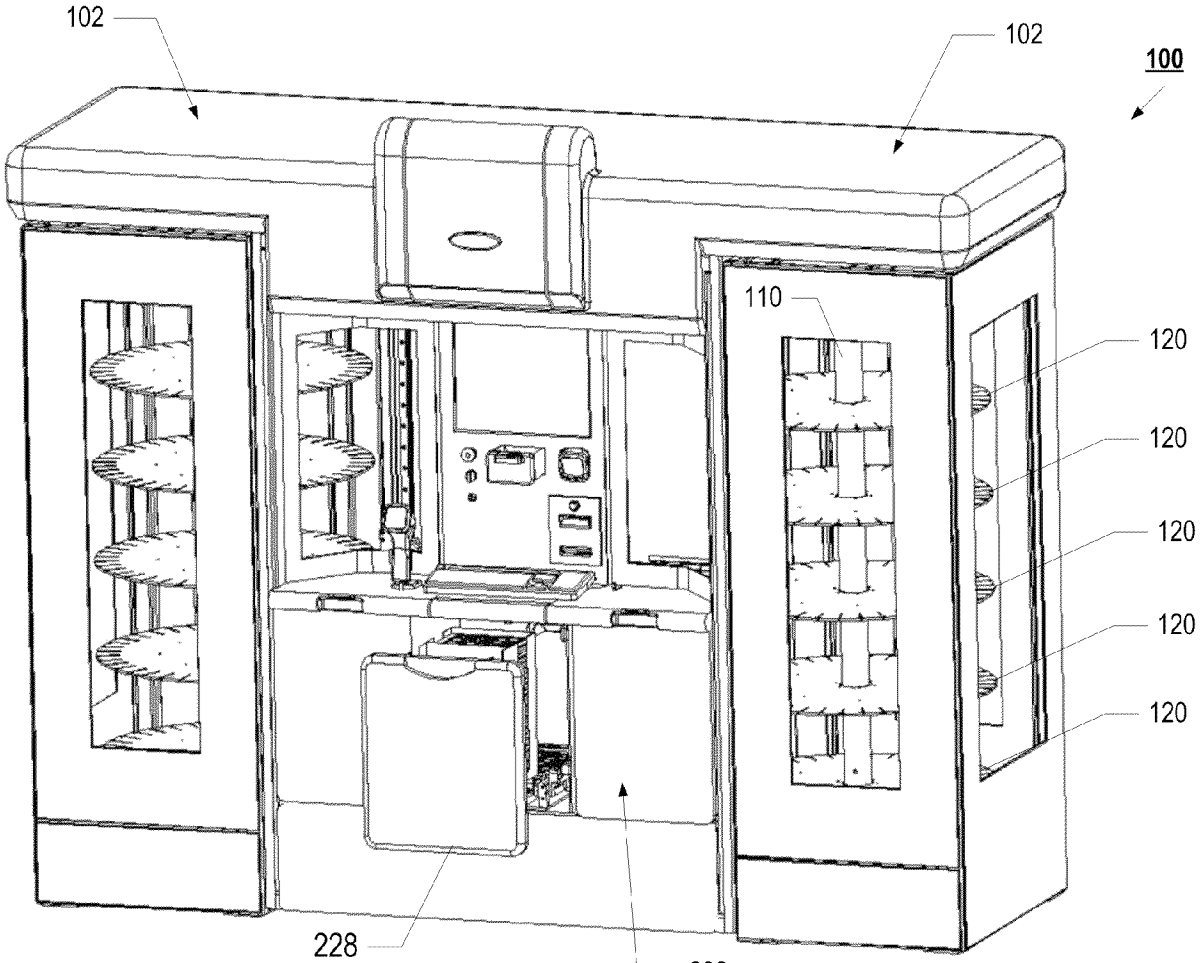
FIGS. 3 and 4 illustrate a storage, retrieval and delivery system in accordance with exemplary embodiments of the present invention.
Figure 4:
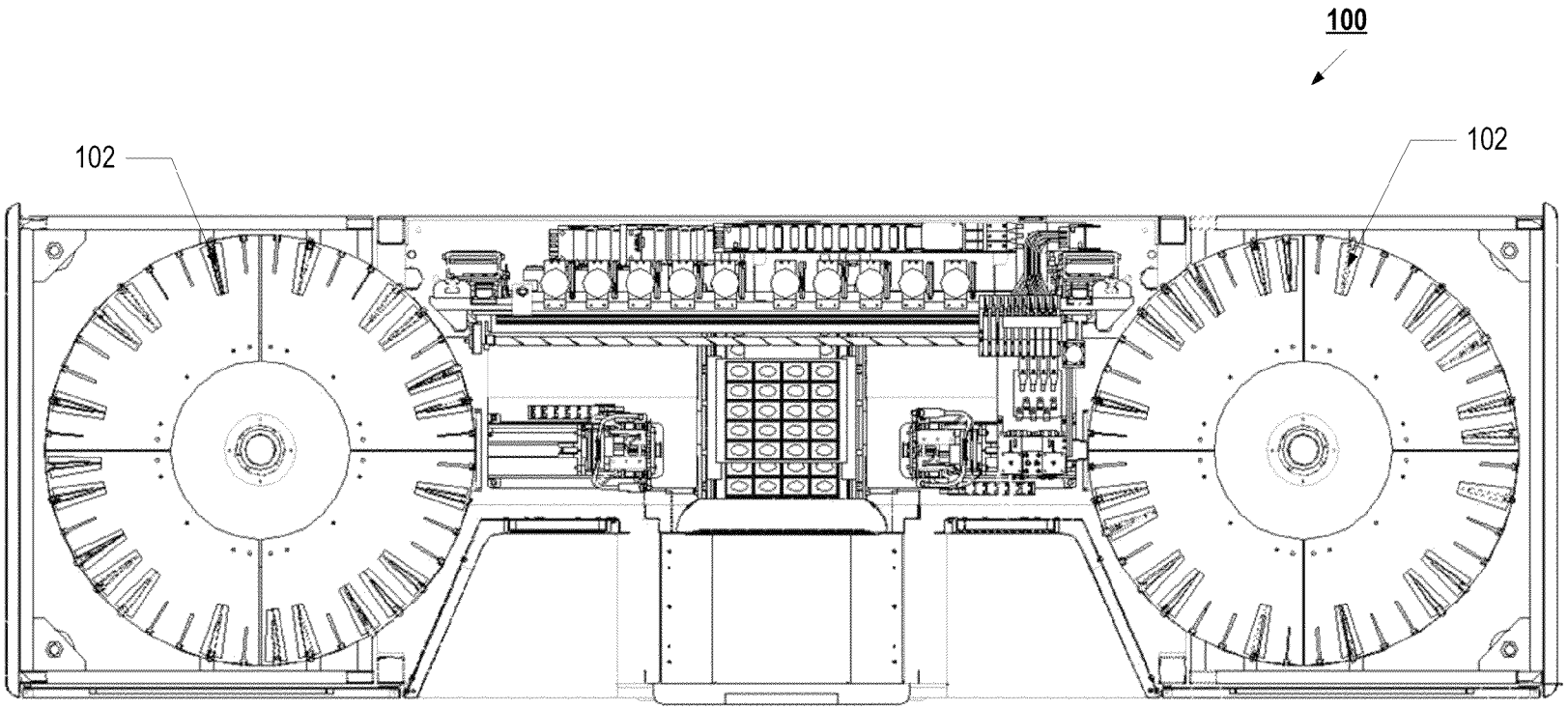

Reference is now made to FIGS. 3 and 4, which illustrate one example of a storage, retrieval and dispensing system 100, in which exemplary embodiments of the present invention may be implemented. As one of ordinary skill in the art will recognize, the system 100 illustrated and described herein is just one manner in which the unit dose packages, or packages containing unit dose medications (e.g., unit dose blisters) may be handled in their natural or raw state (i.e. not over-wrapped or repackaged) in accordance with exemplary embodiments of the present invention. The system 100 of FIGS. 3 and 4 is provided for exemplary purposes only and should not be taken as limiting the scope of the invention in any way, since other systems may likewise be implemented without departing from the spirit and scope of the present invention.

Figure 5:
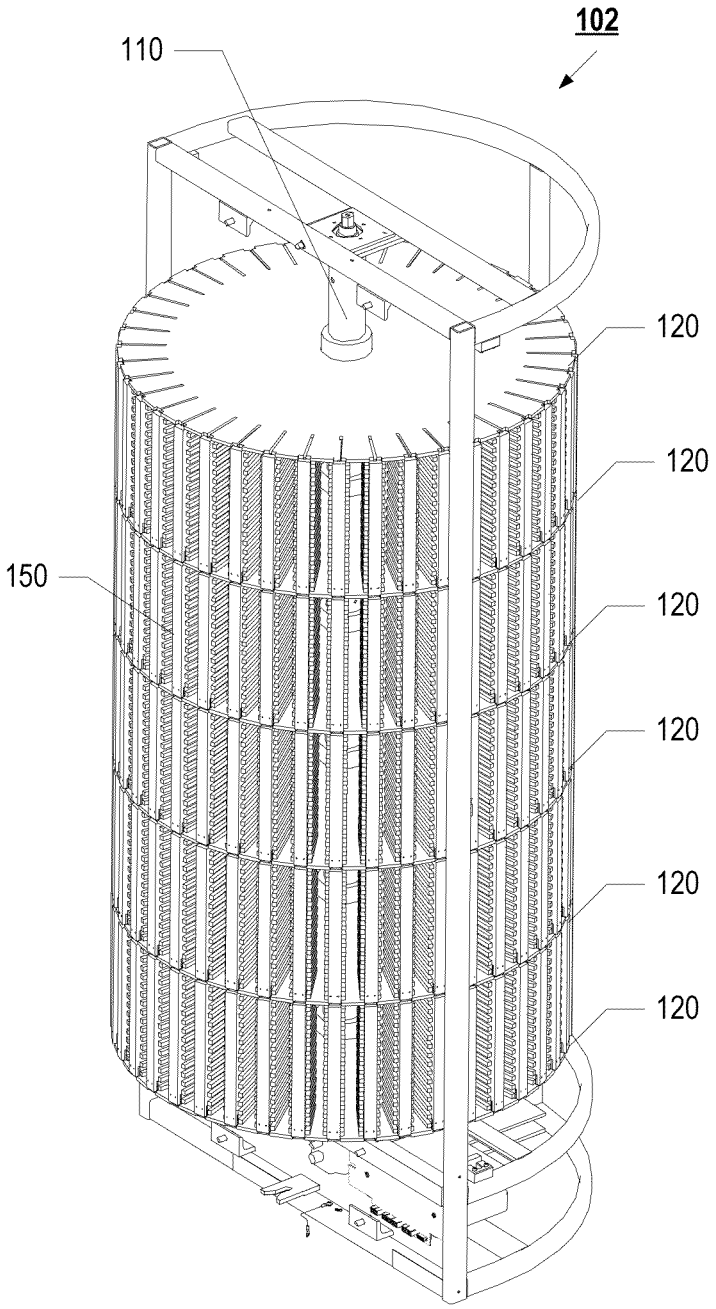
FIG. 5 illustrates a storage system in accordance with exemplary embodiments of the present invention.

The system 100 of exemplary embodiments may include a means for storing a plurality of unit dose blisters of various shapes and sizes, referred to herein as a "storage system" 102. As shown, the storage system 102 of one exemplary embodiment, which is also illustrated in FIG. 5, may be in the form of one or more carousels capable of rotating around a rod or pole 110 extending upward through the center of the carousel 102. While not shown, the storage system may, alternatively, comprise a linear track that is stationary and essentially resembles a plurality of pigeon holes or mail slots each including a unit dose package mount (e.g., a unit dose blister mount), which is described in detail below. Returning to FIGS. 3 and 4, the rod or pole 110 may be configured to support a plurality of circular panels 120 positioned at some distance from one another, wherein each panel is, in turn, configured to support a plurality of unit dose package mounts (e.g., unit dose blister mounts) (not shown in FIG. 3 or 5), via a plurality of package mount receptacles 150 (e.g., blister mount receptacles—shown in FIG. 5).

In this regard, the blister mount receptacles 150 of one embodiment shown in FIG. 5 extend between adjacent panels 120 so as to define a plurality of wedge-shaped cavities. While the panels 120 could be spaced and the unit dose blister mounts sized such that each wedge-shaped cavity defined by the blister mount receptacles 150 received a single unit dose blister mount, the storage system 102 of the illustrated embodiment is capable of storing a plurality of unit dose blister mounts within each wedge-shaped cavity. In this regard, the blister mount receptacles 150 can include tracks for engaging corresponding grooves or other features defined by the unit dose blister mounts such that multiple unit dose blister mounts can be inserted into a single storage location, e.g., a single wedge-shaped cavity, in an organized manner.

Figure 6:
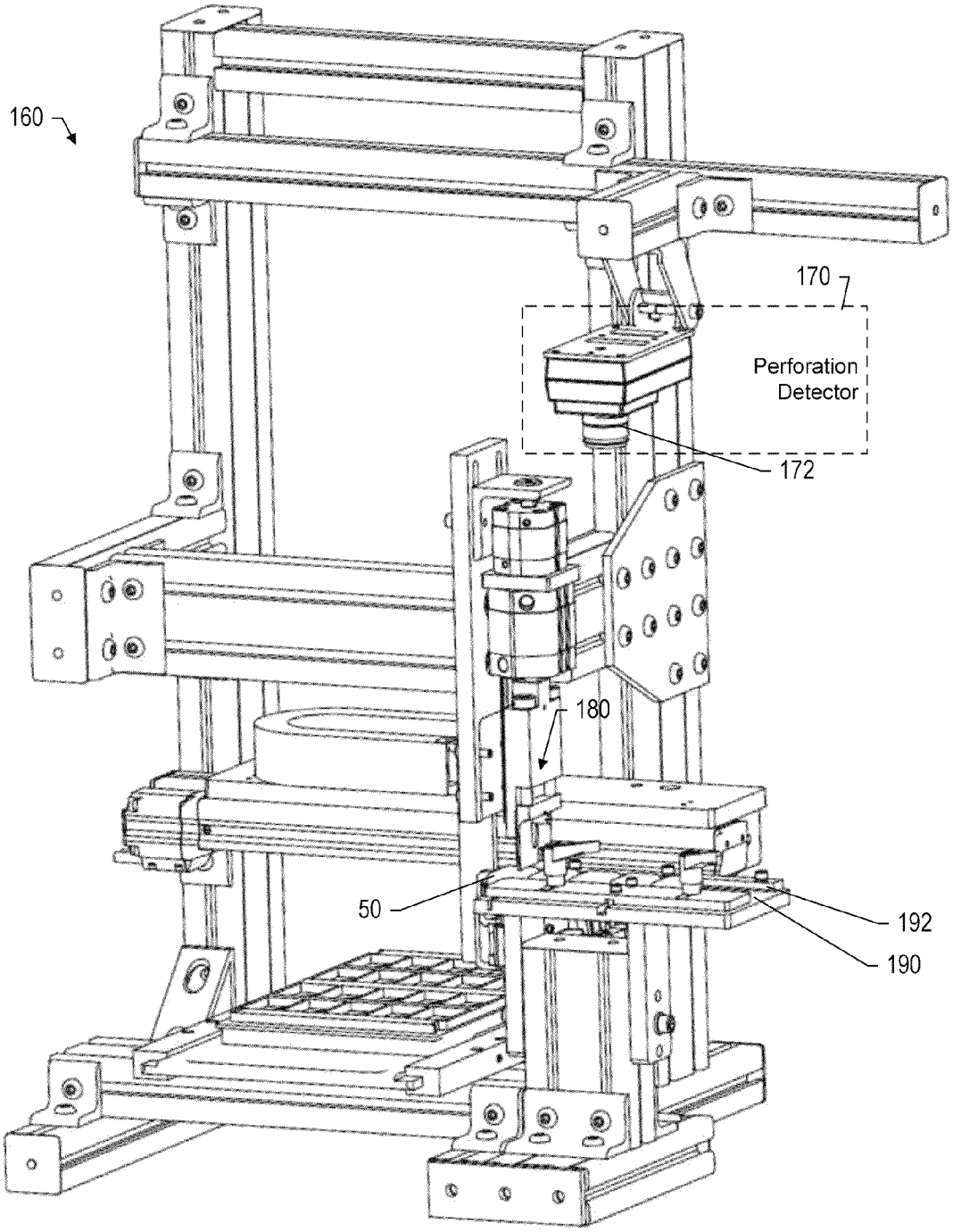
FIG. 6 illustrates a block diagram of a blister singulator according to an exemplary embodiment of the present invention.

In an exemplary embodiment, the system of FIGS. 3-5 may further include a unit dose blister singulator, an exemplary embodiment of which is shown in FIG. 6. FIG. 6 illustrates a block diagram of a blister singulator 160 according to an exemplary embodiment. The blister singulator 160 according to one exemplary embodiment may be a device comprising mechanical and electrical components configured to enable the blister singulator 160 to identify locations of perforations on a blister card and cut the blister card based on the identified locations in order to singulate individual unit dose blisters.

As shown in FIG. 6, the blister singulator 160 of an exemplary embodiment may include a perforation detector 170 and a blister card cutter 180. The perforation detector 170 and the blister card cutter 180 may each be any means or combination of means such as a device or circuitry (or combination thereof) embodied in either hardware, computer program product, or a combination of hardware and computer program product that is configured to perform the corresponding functions of the perforation detector 170 and the blister card cutter 180, respectively, as described herein.

In an exemplary embodiment, at least one blister card 50 (e.g., from a strip 1×5 to 10×10) may be passed proximate to the perforation detector 170 along a media path (a portion of which is shown by the platform forming media path 190 on which the blister card 50 rests in FIG. 6) and the perforation detector 170 may detect perforations on the blister card 50 as described in greater detail below. In some cases, the media path 190 may be characterized by including a plurality of blister cards sequentially passed proximate to the perforation detector 170 and therefore sequentially having their respective perforation locations identified. The blister card cutter 180 may be configured to receive perforation location information for the blister card 50 (or for more than one blister card) and cut the blister card according to the perforation location information. In some cases, the blister card cutter 180 may immediately cut the blister card 50 in response to receipt of the perforation location information before perforation location information is determined for a next blister card. However, in an alternative embodiment, blister cards may be indexed along the media path 190 in a known or determinable sequence and each blister card may have corresponding perforation location information determined and communicated to the blister card cutter 180. The blister card cutter 180 may then cut each corresponding blister card based on the perforation location information that corresponds to the blister card currently indexed to the blister card cutter. In some cases, a blister card identifier may be used to identify each respective blister card and perforation location information may be stored in connection with each blister card based on a mapping of perforation location information to each corresponding blister card identifier.

Figure 7:
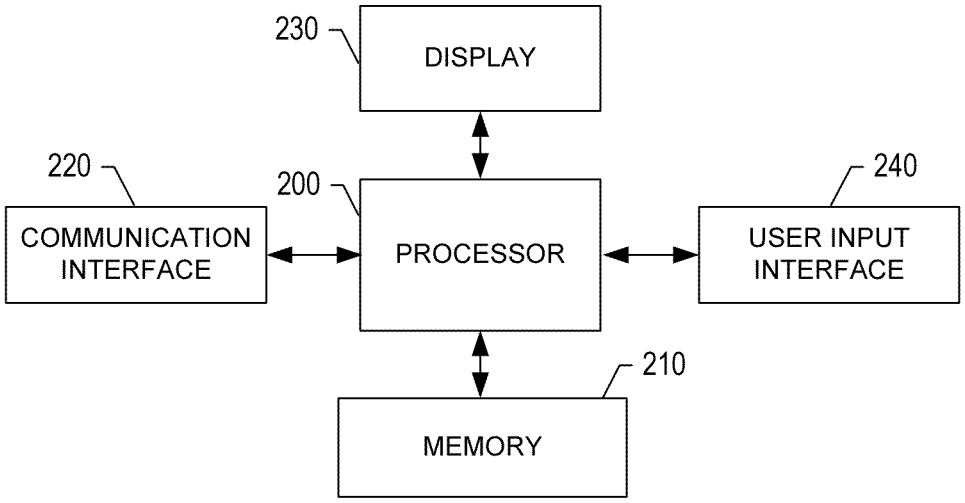
FIG. 7 illustrates a block diagram of a controller, or similar electronic device, capable of performing various functions as part of a storage, retrieval and delivery system in accordance with exemplary embodiments of the present invention.

In an exemplary embodiment, one or both of the perforation detector 170 and the blister card cutter 180 may include or otherwise operate under the control of processing circuitry, an example of which is shown in FIG. 7. Moreover, the processing circuitry of FIG. 7 may also control the storage, retrieval and delivery system 100 of exemplary embodiments of the present invention. As such, the system 100 may further comprise a processor, controller, or similar processing device, capable of directing the perforation detector 170 and the blister card cutter 180 as described herein.

An exemplary embodiment will now be described referring to FIG. 7, which is a block diagram of a controller, or similar processing device, capable of operating in accordance with an exemplary embodiment of the present invention. As shown, the processing circuitry may include various means for performing one or more functions in accordance with exemplary embodiments of the present invention, including those more particularly shown and described herein. It should be understood, however, that the processing circuitry, which may include a controller, or similar processing device, may include alternative means for performing one or more like functions, without departing from the spirit and scope of the present invention. As shown, the processing circuitry may include a processor 200 connected to a memory 210. In addition to the memory 210, the processor 200 may also be connected to at least one interface or other means for displaying, transmitting and/or receiving data, content or the like. In this regard, the interface(s) can include at least one communication interface 220 or other means for transmitting and/or receiving data, content or the like, as well as at least one user interface that may include a display 230 and/or a user input interface 240. The user input interface 240, in turn, may comprise any of a number of devices allowing the controller to receive data from a user, such as a keypad, a touch display, a joystick or other input device.

The processor 200 may be embodied as various processing means such as a processing element, a coprocessor, a controller or various other processing devices including integrated circuits such as, for example, an ASIC (application specific integrated circuit), an FPGA (field programmable gate array), a hardware accelerator, or the like. The processor 200 may be configured (e.g., via hardcoded instructions or via execution of software instructions) to perform or control the various functions of the processing circuitry. The memory 210 may include volatile and/or non-volatile memory, and typically stores content, data or the like. For example, the memory 210 may store content transmitted from, and/or received by, the processing circuitry. Also for example, the memory 210 may store software applications, instructions or the like for the processor 200 to perform steps associated with operation of the processing circuitry in accordance with embodiments of the present invention.

In one exemplary embodiment, the memory 210 stores instructions for directing the processor 200 to control the perforation detector 170 in relation to detecting perforation location information for the blister card 50. Once perforation location information has been determined for the blister card 50, the memory 210 may further store (e.g., temporarily) the perforation location information for use by the processor 200 in directing the blister card cutter 180 in cutting the blister card 50 according to the perforation location information to separate unit dose blisters of the blister card 50 along the perforations. As such, in addition to the instructions for directing the perforation detector 170 and the blister card cutter 180 to perform their respective operations, in one exemplary embodiment, the memory 210 further stores coordinate information such as distance information defining a distance from an edge of the blister card (e.g., a reference edge) to a first perforation and thereafter a distance between each subsequent perforation line. The process of perforation location information determination may be repeated (or simultaneously accomplished) in horizontal and vertical directions under the control of the processor 200. However, in an exemplary embodiment, rather than a single processor controlling both the perforation detector 170 and the blister card cutter 180, each of the perforation detector 170 and the blister card cutter 180 may include their own respective instances of the processor 200 and the memory 210.

Thus, according to one example, the memory 210 may temporarily store the distances X, X' and X" along with distances Y, Y' and Y" for use by the blister card cutter 180 in cutting the blister card 50. In an exemplary embodiment, the media path 190 may be characterized by having a "fence" 192 against which a reference edge of the blister card 50 may be mated in order to provide a reference from which distances from the edge of the blister card 50 may be measured with respect to each perforation line detected. In some cases, a fence may be provided in each of the horizontal and vertical directions in order to provide a reference edge from which to measure distances X, X' and X" along with distances Y, Y' and Y". Thus, a distance to a first perforation may be measured from the reference edge and each distance to a subsequent perforation may be measured from the prior perforation. However, distances could alternatively all be measured from the reference edge and not from adjacent perforations. In some cases, only a position of the first distance (e.g., X or Y) from the reference edge may need to be determined as the distances between perforations may be consistent and/or known based on the type of blister card.

In an exemplary embodiment, the blister card cutter 180 may include one or more adjustable cutting instrument (e.g., one or more cutting blades) that may be aligned relative to the reference edge. Although the adjustable cutting instrument may be manually adjustable, in some embodiments, the adjustable cutting instrument may be programmable and/or automatically adjustable. In cases where the blister card cutter 180 includes a single blade, the blade may be configured to ride a track or carriage assembly that extends in a direction substantially parallel to the reference edge at an adjustable distance from the reference edge. Thus, for example in reference to FIG. 2 and assuming a vertical cutting orientation, the left edge of the blister card 50 may be the reference edge of the blister card 50, which may be held against a fence and the distance X' may be set as the adjustable distance at which the blade of the blister card cutter 180 may be passed over the blister card 50 in order to cut along the perforation 70. As an alternative, the blade may be set at a distance X' from the reference edge and the blister card 50 may be moved relative to the blade along the media path 190 in order to affect the cutting along the perforation 70. Subsequent cuts may be made by adjusting the blade from the distance X' to a distance X'+X and later to a distance X'+2X in order to complete the remaining vertical cuts. A similar process may then be repeated in order to perform cuts in the horizontal direction. In one embodiment, the blister card 50 may be shifted in orientation so that the blade maintains one orientation with respect to the fence and the remaining cuts (e.g., cuts at Y' from the corresponding reference edge and Y from each other perforation) may be accomplished on the blister card 50.

In one exemplary embodiment in which multiple blades are employed, a plurality of blades may be positioned to make respective cuts at a distance X' or X" (or Y' or Y") from an edge of the blister card 50 and at distance X (or Y) from perforation lines measured from another perforation line rather than from an edge of the blister card 50. In some cases, the blades may be adjusted to make first cuts along one direction (e.g., the horizontal direction) and then the blades may be adjusted to make second cuts along another direction substantially perpendicular to the direction of the first cuts (e.g., the vertical direction). However, in some cases, the adjustable cutting blades may be adjusted between cuts, but maintained in a constant orientation and an orientation of the blister card 50 may be adjusted. In yet another alternative embodiment, two sets of adjustable blades may be employed in which each of the two sets has an orientation that corresponds to the orientations of the perforations 70 (e.g., a vertically oriented blade set and a horizontally oriented blade set). In any case, either the blades may be moved relative to the blister card 50 or the blister card 50 may be moved relative to the blades (or both may move) in order to perform the cutting. FIG. 2 shows an example of the blade 94 (although multiple blades may be included) aligned with respect to the reference edge 90 in order to cut perforation 92 a distance Y' from the reference edge 90.

The perforation detector 170 may be configured to provide the perforation location information to the blister card cutter 180 in any one of numerous alternative ways. Generally speaking, the perforation detector 170 may determine perforation location information based on data gathered from a sensor 172 that may form a portion of or otherwise be in communication with the perforation detector 170. The sensor 172 may be configured to perform an information extraction operation with respect to a surface of a blister card proximate to the sensor 172 to extract data for facilitating determination of perforation location information and the perforation detector 170 may communicate the extracted data to the perforation detector 170. The perforation detector 170 may be configured to determine perforation location information based on and in response to extraction of the extracted data. The sensor 172 may be embodied in different ways depending upon the perforation detection method employed by the perforation detector 170. FIGS. 8-12 illustrate various examples of some different sensors that may be employed in alternative embodiments.

Figure 8:
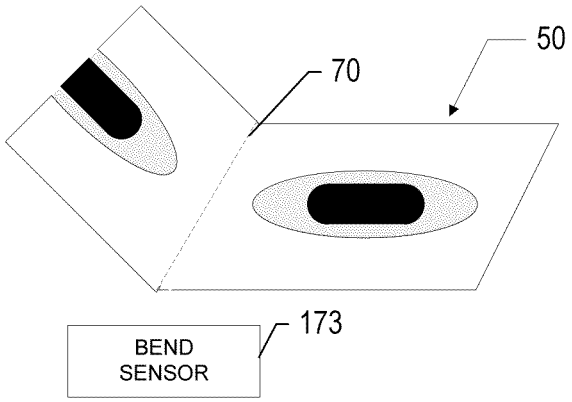
FIG. 8 illustrates a block diagram of a perforation detector in accordance with an exemplary embodiment of the present invention.

In this regard, in an exemplary embodiment as shown in the example of FIG. 8, the sensor 172 may be embodied as a bend sensor 173. FIG. 8 shows a portion of the blister card 50 being bent such that the blister card deforms or bends at the perforation 70. The bend sensor 173 may be an optical and/or mechanical sensor configured to detect a bend in the blister card 50. In an exemplary embodiment, the blister card 50 may be indexed past the bend sensor and the media path 190 may include an incline, decline or other bending mechanism such as the application of pressure to opposite edges or sides of the blister card 50 in order to facilitate bending of the blister card 50. When pressure is applied in the presence of a perforation, the blister card 50 can be assumed to bend at the perforation. Thus, the bending sensor 173 may be configured to measure (e.g., with respect to a reference edge or another perforation) and/or identify a location of the bend in order to determine perforation location information that may be communicated to the perforation detector 170. Accordingly, for this example, the bending sensor 173 may be configured to perform an information extraction operation with respect to a surface of a blister card by extracting data indicative of a location of a bend in the blister card, and the perforation location information may be determined based on the location of the bend. The location of the bend may be identified as a portion of the blister card 50 at which a peak (or valley) is formed in response to the application of pressure to bend the blister card 50. However, in some examples, no bending sensor 173 may be employed in order to determine perforation location information. For example, rather than using a sensor to detect a valley formed in the surface of the blister card 50, a blade or other instrument may be allowed to fall into the valley created by the bending in order to cut the blister card 50 along the valley and therefore along the perforation.

Figure 9:
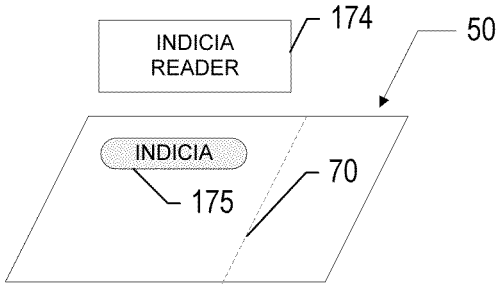
FIG. 9 illustrates a block diagram of a perforation detector in accordance with another exemplary embodiment of the present invention.

In an alternative embodiment such as that shown in the example of FIG. 9, the sensor 172 may be embodied as an indicia reader 174 configured to perform optical or laser scanning of label information or some other indicia 175 printed on a surface of the blister card 50. In an exemplary embodiment, the indicia 175 may include a barcode (e.g., of an NDC) associated with the blister card 50. The NDC or other indicia 175 may be stored in a database that may be referenced by the perforation detector 170 (or the processor 200) in order to determine the perforation location information for the blister card 50. In this regard, for example, the indicia 175 may be mapped in the database with perforation location information specific to the medication or substance associated with the unit dose blisters of the blister card 50. For example, the indicia 175 may be mapped together with infoiniation defining, for the blister card 50 associated with the indicia 175, the general dimensions of the blister card 50 (e.g., length, width, number of columns, number of rows, etc.) and specific measurements associated with the blister card 50 (e.g., the distance between the perforations). Thus, for this example, the indicia reader may be configured to perform an information extraction operation with respect to a surface of a blister card by extracting the indicia indicative of a location of a perforation in the blister card, and the perforation location information may be determined based on the indicia.

The indicia reader 174 may be embodied as, for example, a barcode or RFID tag reader, or a camera configured to capture an image of a portion of the blister card (e.g., having the indicia 175) and then analyze the image in order to extract the desired information. Reference to scanning the portion of the blister card may, therefore, include scanning one or more optical signals across the portion of the blister card or, alternatively, where an image of the portion of the blister card has been captured using a camera, decoding or interrogating the pixels of that image.

Figure 10:
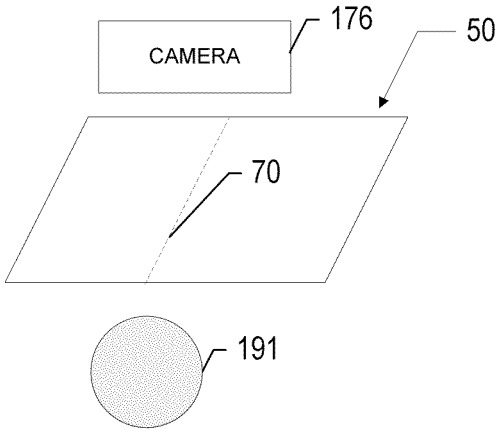
FIG. 10 illustrates a block diagram of a perforation detector in accordance with yet another exemplary embodiment of the present invention.

In another alternative embodiment such as that shown in the example of FIG. 10, the sensor 172 may be embodied as a camera 176 (similar to the example of FIG. 6) or light sensor configured to perform optical scanning of a surface of the blister card 50. In an exemplary embodiment, a light source 191 may be positioned along the media path 190 on an opposite side of the blister card 50 than the side on which the camera 176 is positioned. The light source 191 may operate continuously or when directed in order to illuminate the blister card 50. Areas that are perforated may be expected to allow more light to pass through and thus, the camera 176 may detect the perforations 70 based on the amount of light passing through the blister card 50 in order to determine the perforation location information. As an alternative to this embodiment, the light source 191 could be positioned on the same side of the blister card 50 that the camera 176 or light sensor is on and the camera 176 or light sensor may measure reflected light off the surface of the blister card 50. It may be assumed that the perforated regions reflect light differently than other regions and thus, the camera 176 or light sensor may be configured to determine the perforation location information based on the amount of reflected light sensed. Thus, for this example, the camera 176 or light sensor may be configured to perform an information extraction operation with respect to a surface of a blister card by extracting data indicative of the amount of reflected light or light passing through the perforation 70, and the perforation location information may be determined based on the extracted data.

Figure 11:
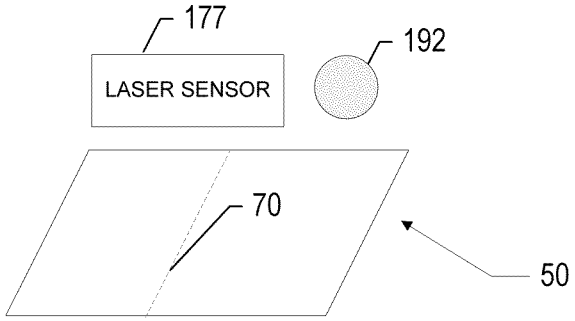
FIG. 11 illustrates a block diagram of a perforation detector in accordance with still another exemplary embodiment of the present invention.

In yet another alternative embodiment such as that shown in the example of FIG. 11, the sensor 172 may be embodied as a laser sensor 177 configured to perform optical scanning of a surface of the blister card 50. In an exemplary embodiment, the measurement device or sensor (e.g., laser sensor 177) may be positioned along the media path 190 on a same side of the blister card 50 on which a laser 192 is positioned. The laser 192 may operate continuously or when directed in order to measure a distance from the measurement device to the surface of the blister card 50 based on the time taken for a laser to reach the surface of the blister card and return to the measurement device. Areas that are perforated may be expected to indicate a different distance than other regions and thus, the laser sensor 177 may be configured to determine the perforation location information based on the distance information sensed. As such, the laser sensor 177 may be configured to detect variations (e.g., perforations) in blister card surface features. Thus, for this example, the laser sensor 177 may be configured to perform an information extraction operation with respect to a surface of a blister card by extracting data indicative of variations in features on the blister card surface that correspond to the perforation 70, and the perforation location information may be determined based on the extracted data.

Figure 12:
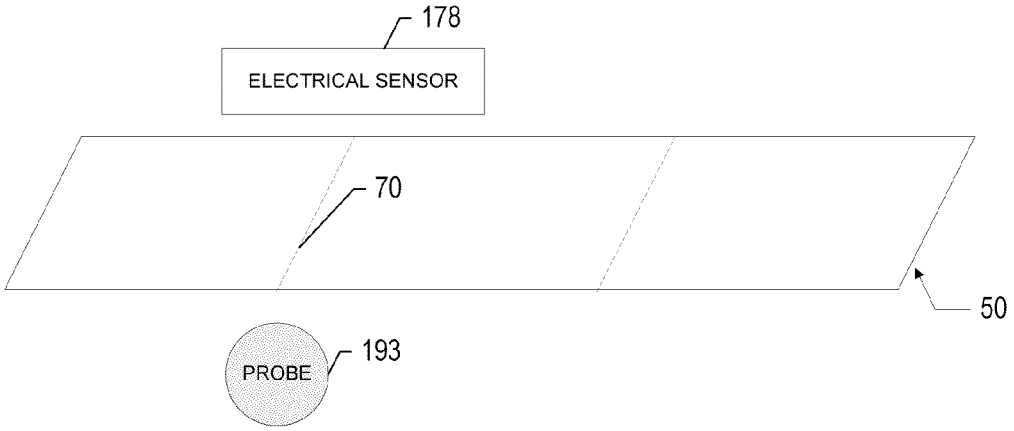
FIG. 12 illustrates a block diagram of a perforation detector in accordance with yet still another exemplary embodiment of the present invention.

In still another alternative embodiment such as that shown in the example of FIG. 12, the sensor 172 may be embodied as an electrical sensor 178 configured to perform electrical scanning of a surface of the blister card 50. In an exemplary embodiment, the electrical sensor 178 may be positioned along the media path 190 on an opposite side of the blister card 50 than the side on which an electrical probe 193 is positioned. In an exemplary embodiment, the electrical probe 193 and the electrical sensor 178 may be substantially aligned such that the electrical sensor 178 detects the charge produced by the electrical probe 193 in the absence of any blister card. The electrical probe 193 may operate continuously or when directed in order to provide an electric charge on one side of the blister card 50. The blister card 50 may be passed over the media path 190 such that when areas that are not perforated are positioned between the electrical probe 193 and the electrical sensor 178, the charge produced by the electrical probe 193 is substantially insulated from the electrical sensor 178. However, when an area of the blister card 50 that corresponds to the perforation 70 is between the electrical probe 193 and the electrical sensor 178, the electrical sensor 178 receives an increased reading thereby indicating the presence of the perforation 70. In an exemplary embodiment, one or both of the electrical probe 193 and the electrical sensor 178 may extend over the length of the blister card 50 such that portions of the electrical sensor 178 that receive larger readings may be assumed to correspond to perforations and such portions may be accurately known by knowing the length and/or position of the electrical sensor 178 and/or electrical probe 193. In another exemplary embodiment, lengths and/or positions of the electrical sensor 178 and/or electrical probe 193 may be known or accurately determined relative to an edge of the blister card 50 for perforation information determination. Thus, for this example, the electrical sensor 178 may be configured to perform an information extraction operation with respect to a surface of a blister card by extracting data indicative of variations in electric field as measured proximate to the blister card surface and that indicate locations of the perforation 70, and the perforation location information may be determined based on the extracted data.

In an exemplary embodiment, the system 100 may further include a means for selectively retrieving a unit dose blister (or similar unit dose package) from the storage system and delivering the unit dose blister to a specified location, referred to herein as a "picking system", which may generally be disposed proximate to the storage system 102 in order to enable the picking system to select a blister card from corresponding package mount receptacles 150. A front panel 202, behind which the picking system of one exemplary embodiment may be located, is illustrated in FIG. 3. The picking system may include X-Axis, Y-Axis and Z-Axis components configured to enable the picking system to move in three, mutually orthogonal directions, designated X, Y and Z, in order to retrieve a unit dose blister, typically while disposed within a unit dose blister mount, from the storage system 102.

Figure 13A:
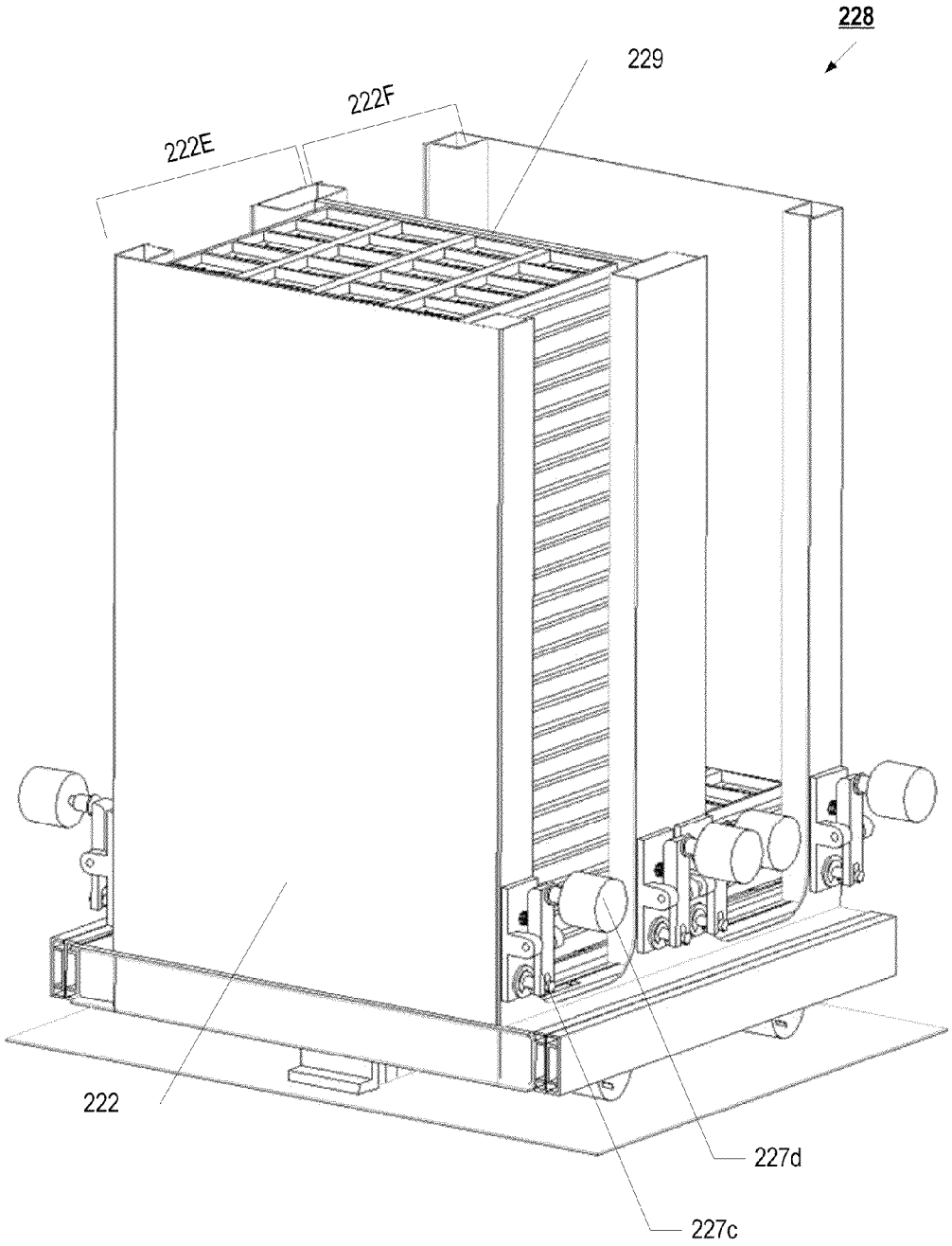
FIGS. 13A and 13B illustrate a tray delivery/removal mechanism in accordance with exemplary embodiments of the present invention.
Figure 13B:
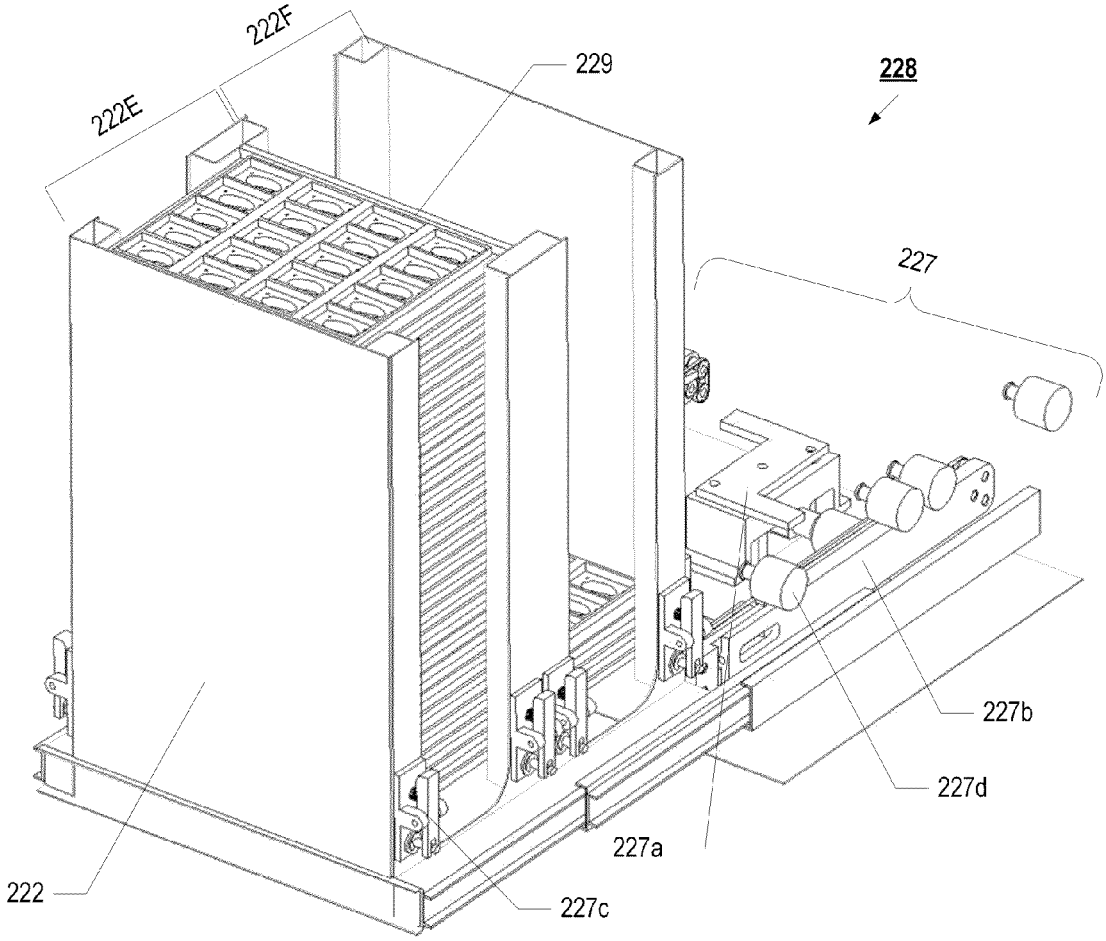

As also shown in FIG. 3, the system 100 may further comprise one or more tray delivery/removal systems 228, which may be used by the storage, retrieval and dispensing system 100 to restock the storage system 102 with unit dose blisters (or similar unit dose packages). As illustrated in FIGS. 13A and 13B, in one exemplary embodiment, the tray delivery/removal system 228 may comprise a drawer 222 that is capable of being opened (i.e., pulled away from the storage, retrieval and dispending system 100 as shown in FIG. 13B) or closed (as shown in FIG. 13A) for the purpose of loading and unloading restock trays 229, and is divided into two sections 222F and 222E, wherein each section is configured to hold approximately 25 restock trays 229, each of which is further configured to hold approximately 20 singulated unit dose blisters. The first section 222F may be used to hold restock trays 229 that are full of unit dose blisters and have been placed in the tray delivery/removal system 228, for example, by a technician for the purpose of restocking the storage system 102. In contrast, the second section 222E may hold empty restock trays 229, or trays from which the picking system has already removed the unit dose blisters and placed them in the storage system 102.

In one exemplary embodiment, blisters that have been singulated (i.e., separated into unit doses) by the perforation detector 170 and the blister card cutter 180 of an exemplary embodiment of the present invention may be loaded into the restock trays 229. In some cases, the restock trays 229 may be loaded with singulated unit dose blisters by a pharmacy technician after singulation by the perforation detector 170 and the blister card cutter 180. However, in at least one exemplary embodiment, the perforation detector 170 and the blister card cutter 180 may be included as a portion of the system 100 and singulated unit dose blisters may be automatically transferred into the restock trays 229 after passing along the media path 190 and having singulation operations conducted thereon. In addition, already singulated unit dose blisters that have been returned, for whatever reason, from a patient (or cabinet) may also be loaded into the restock trays 229. In embodiments where the restock trays are manually loaded, a pharmacy technician may then open the drawer 222, load the tray 229 (or stack of trays) into the first section 222F of the drawer 222, and then close the drawer 222 to enable the restocking process to begin. Once the first section 222F of the drawer 222 has been filled with restock trays 229 carrying unit dose blisters (or at any point when it is desired to restock the storage, retrieval and dispensing system 100), a tray removal system 227, essentially comprising a lifting mechanism 227*a*, a reversing conveyor 227*b*, a plurality of tray holding latches 227*c* and a corresponding plurality of tray holding latch actuators 227*d* will singulate the bottom tray 229 in the stack of trays in the full section 222F of the drawer 222, and transfer the singulated tray 229 to the picking system. In particular, in one exemplary embodiment, the lifting mechanism 227*a* will extend upward lifting the stack of trays 229 in the full section 222F of the drawer 222 off of the tray holding latches 227*c*, which are configured to hold the stack of trays 229. The tray holding latch actuators 227*d* can then be extended outward in order to retract the tray holding latches 227*c*, in other words, to remove the tray holding latches 227*c* from the bottom of the stack of trays 229. The lifting mechanism 227*a* can then retract or drop the height of one tray 229, and the tray holding latch actuators 227*d* can then be extended back inward in order to allow the tray holding latches 227*c* to extend under the stack of trays one tray 229 up from the bottom tray 229.

Finally, the lifting mechanism 227*a* can lower the rest of the way, such that the tray holding latches 227*c* now support the remaining trays (i.e., the original stack of trays minus the bottom tray), and the singulated bottom tray now rests on the reversing conveyer 227*b*.

Once the singulated tray has been transferred to the picking system via the reversing conveyer 227*b*, the picking system can then deposit each unit dose blister into a unit dose blister mount at a specified location within the storage system 102. Once all of the unit dose blisters have been removed from the restock tray 229 the tray removal system 227 will transfer the empty tray 229 to the second section 222E of the drawer 222 (in a manner substantially opposite that discussed above with respect to singulation of the bottom full tray), from which it can be removed by a technician upon opening the drawer 222.

Figure 14:
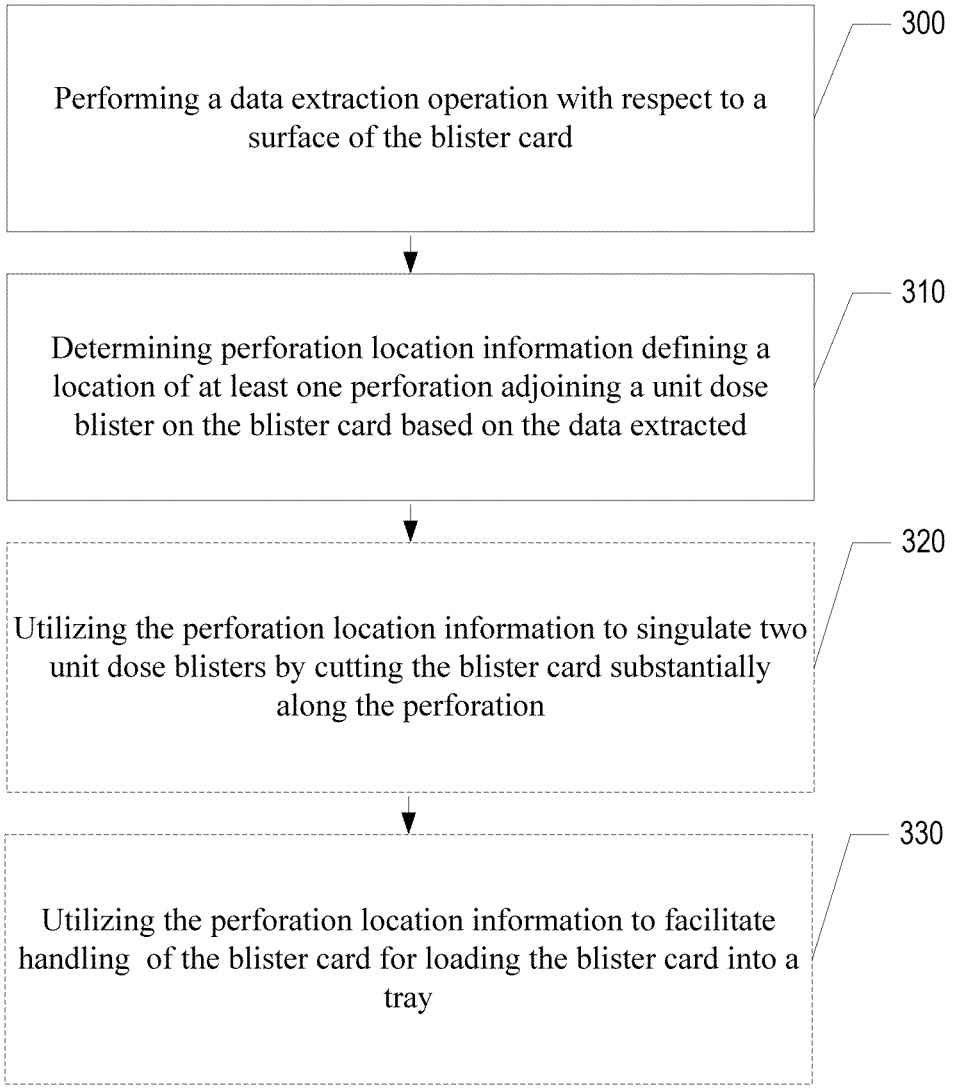
FIG. 14 is a flow chart illustrating a method for determining a perforation location on a blister card in accordance with an exemplary embodiment of the present invention.

FIG. 14 is a flowchart of a method and program product according to exemplary embodiments of the invention. It will be understood that each block or step of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device and executed by a processor (e.g., processor 200). As will be appreciated, any such computer program instructions may be loaded onto a computer or other programmable apparatus (i.e., hardware) to produce a machine, such that the instructions which execute on the computer or other programmable apparatus create means for implementing the functions specified in the flowchart block(s) or step(s). These computer program instructions may also be stored in a computer-readable memory that may direct a computer or other programmable apparatus to function in a particular manner, such that the instructions stored in the computer-readable memory produce an article of manufacture including instruction means which implement the function specified in the flowchart block(s) or step(s). The computer program instructions may also be loaded onto a computer or other programmable apparatus to cause a series of operational steps to be performed on the computer or other programmable apparatus to produce a computer-implemented process such that the instructions which execute on the computer or other programmable apparatus provide steps for implementing the functions specified in the flowchart block(s) or step(s).

In this regard, a method according to one embodiment of the invention, as shown in FIG. 14, may include performing a data extraction operation with respect to a surface of the blister card at operation 300 and determining perforation location information defining a location of at least one perforation between two unit dose blisters on the blister card based on the data extracted at operation 310. In some embodiments, additional optional operations may be included, some examples of which is shown in dotted lines in FIG. 14. In this regard, for example, the method may further include utilizing the perforation location information to singulate the two unit dose blisters by cutting the blister card substantially along the perforation at operation 320. In some embodiments, the method may yet further include utilizing the perforation location information to facilitate handling (e.g., grabbing) of the blister card for loading the blister card into a tray at operation 330.

In some embodiments, certain ones of the operations above may be modified or further amplified as described below. It should be appreciated that each of the modifications or amplifications below may be included with the operations above either alone or in combination with any others among the features described herein. In this regard, for example, utilizing the perforation location information to singulate the two unit dose blisters may include setting a blade position of at least one adjustable blade based on the perforation location information and cutting along the perforation using at least one adjustable blade. In an exemplary embodiment, performing the data extraction operation with respect to the surface of the blister card may include bending the blister card, and determining perforation location information may include determining a position of the blister card at which the blister card is bent. Alternatively, performing the data extraction operation with respect to the surface of the blister card may include scanning a surface of the blister card with a reader to extract indicia of the blister card, and determining perforation location information may include referencing a database to determine the perforation location information based on a mapping of different indicia to respective perforation location data. In another alternative, performing the data extraction operation with respect to the surface of the blister card may include detecting an amount of light passing through the blister card, and determining perforation location information may include determining a position of a perforation line based on the amount of light passing through a respective portion of the blister card. In yet another alternative, performing the data extraction operation with respect to the surface of the blister card may include scanning the surface with a laser sensor, and determining perforation location information may include determining a position of a perforation line based on discontinuities detected by the laser sensor on the surface of the blister card. In yet another alternative, performing the data extraction operation with respect to the surface of the blister card may include detecting an amount of electrical charge passing through the blister card, and determining perforation location information may include determining a position of a perforation line based on the amount of electrical charge detected at a respective portion of the blister card.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A method of determining a perforation location on a blister card comprising at least one unit dose blister of medication, the method comprising:

performing a data extraction operation with respect to a surface of the blister card wherein performing the data extraction operation with respect to the surface of the blister card comprises detecting an amount of electrical charge passing through the blister card;

determining perforation location information defining a location of at least one perforation adjoining two unit dose blisters on the blister card based on the data extracted wherein determining perforation location information comprises determining a position of a perforation line based on the amount of electrical charge detected at a respective portion of the blister card;

mating an edge of the blister card with a fence such that the at least one perforation is spaced therefrom; and utilizing the perforation location information to singulate two unit dose blisters by cutting the blister card substantially along the at least one perforation while the edge of the blister card remains mated with the fence in order to provide a reference from which a distance from the edge of the blister card to the at least one perforation is measured.

2. The method of claim 1, wherein utilizing the perforation location information to singulate the two unit dose blisters comprises:

setting a cutting instrument position of at least one adjustable cutting instrument based on the perforation location information; and cutting along the perforation using the at least one adjustable cutting instrument.

3. The method of claim 1, wherein the blister card comprises a plurality of unit dose blisters arranged in a plurality of rows and a plurality of columns with first and second sets of perforations extending orthogonally to one another, wherein determining perforation location information defining a location of at least one perforation from the first set of perforations and a location of at least one perforation from the second set of perforations.

4. The method of claim 1, further comprising providing the blister card in which a distance between the fence and the perforation closest to the fence is different than a distance between adjacent perforations.

5. An apparatus for determining a perforation location on a blister card comprising at least one unit dose blister of medication, the apparatus comprising:

a perforation detector configured to perform a data extraction operation with respect to a surface of the blister card and determine perforation location information defining a location of at least one perforation adjoining two unit dose blisters on the blister card based on the data extracted wherein the perforation detector comprises a sensor configured to detect an amount of electrical charge passing through the blister card and wherein the perforation detector is configured to determine a position of a perforation line based on the amount of electrical charge detected at a respective portion of the blister card;

a fence with which an edge of the blister card is mated such that the at least one perforation is spaced therefrom; and a cutter configured to utilize the perforation location information to singulate two unit dose blisters by cutting the blister card substantially along the at least one perforation while the edge of the blister card remains mated with the fence in order to provide a reference from which a distance from the edge of the blister card to the at least one perforation is measured.

6. The apparatus of claim 5, wherein the cutter comprises at least one cutting instrument being adjustable based on the perforation location information to cut along the perforation.

7. The apparatus of claim 5, wherein the blister card comprises a plurality of unit dose blisters arranged in a plurality of rows and a plurality of columns with first and second sets of perforations extending orthogonally to one another, wherein the perforation detector is configured to determine perforation location information defining a location of at least one perforation from the first set of perforations and a location of at least one perforation from the second set of perforations.

8. The apparatus of claim 5, wherein the blister card is configured such that a distance between the fence and the perforation closest to the fence is different than a distance between adjacent perforations.

9. A system for determining a perforation location on a blister card comprising at least one unit dose blister of medication, the system comprising:

a perforation detector configured to perform a data extraction operation with respect to a surface of the blister card and determine perforation location information defining a location of at least one perforation adjoining two unit dose blisters on the blister card based on the data extracted wherein the perforation detector comprises a sensor configured to detect an amount of electrical charge passing through the blister card, and wherein the perforation detector is configured to determine a position of a perforation line based on the amount of electrical charge detected at a respective portion;

a fence with which an edge of the blister card is mated such that the at least one perforation is spaced therefrom; and a cutter configured to utilize the perforation location information to singulate the two unit dose blisters by cutting the blister card substantially along the perforation while the edge of the blister card remains mated with the fence in order to provide a reference from which a distance from the edge of the blister card to the at least one perforation is measured.

10. The system of claim 9, wherein the cutter comprises at least one cutting instrument being adjustable based on the perforation location information to cut along the perforation.

11. The system of claim 9, wherein the blister card comprises a plurality of unit dose blisters arranged in a plurality of rows and a plurality of columns with first and second sets of perforations extending orthogonally to one another, wherein the perforation detector is configured to determine perforation location information defining a location of at least one perforation from the first set of perforations and a location of at least one perforation from the second set of perforations, and wherein the cutter is configured to cut the blister card along the at least one perforation from the first set of perforations and along the at least one perforation from the second set of perforations.

12. The system of claim 9, wherein the blister card is configured such that a distance between the fence and the perforation closest to the fence is different than a distance between adjacent perforations.

* * * * *